United States Patent [19]

Ayres et al.

[11] Patent Number: 4,829,643

[45] Date of Patent: May 16, 1989

[54] APPARATUS AND METHOD FOR AUTOMATICALLY SECURING BORDERWIRES ON MATTRESS INNERSPRINGS

[75] Inventors: Donald B. Ayres, Skokie; Arthur Langas, Glenview; Glenn H. Gustafson, Wilmette, all of Ill.

[73] Assignee: Hartco Company, Skokie, Ill.

[21] Appl. No.: 158,900

[22] Filed: Feb. 22, 1988

[51] Int. Cl.[4] ..... B68G 7/00

[52] U.S. Cl. ..... 29/91; 140/3 CA

[58] Field of Search ..... 29/91, 91.3, 91.1, 91.7, 29/91.8, 93 D, 243.56; 140/3, 10–12, 14, 15, 3 CA, 18, 23

[56] References Cited

U.S. PATENT DOCUMENTS 1,589,116 6/1926 Costigan ..... 140/3 CA
2,716,308 8/1955 Hodges, Jr. ..... 29/91
3,698,448 10/1972 Spuhl ..... 140/3 CA
4,724,590 2/1988 Langas et al. ..... 29/91

*Primary Examiner*—Robert L. Spruill
*Attorney, Agent, or Firm*—Wallenstein, Wagner & Hattis, Ltd.

[57] ABSTRACT

Apparatus for automatically securing borderwires on mattress innersprings, including a support member for maintaining a mattress innerspring and borderwires on edge in a substantially upright position as clips are automatically wrapped along the supported edge on each side thereof. A rotatable paddle-like member is provided for rotating the mattress innerspring and the borderwires on the support member to present another edge on which clips are to be wrapped. Control means is provided for carrying out, automatically, each operation performed by the apparatus.

37 Claims, 13 Drawing Sheets

APPARATUS AND METHOD FOR AUTOMATICALLY SECURING BORDERWIRES ON MATTRESS INNERSPRINGS

TECHNICAL FIELD

The present invention relates to apparatus, and a method, for securing borderwires on mattress innersprings.

BACKGROUND OF THE PRIOR ART

In co-pending patent applications Ser. No. 944,561 filed Dec. 22, 1986, now U.S. Pat. No. 4,724,590, dated Feb. 16, 1988 and Ser. No. 120,528, filed Nov. 13, 1987, the latter application being a continuation-in-part application of the former application, there is disclosed apparatus for automatically securing borderwires on mattress innersprings which represents a significant breakthrough in the mattress innerspring manufacturing industry. The apparatus disclosed in said applications comprises horizontally disposed support means on which upper and lower borderwires and a mattress innerspring are positioned in stacked relation to one another. Automatically adjustable alignment means enables the apparatus to be used to secure borderwires on mattress innersprings of the type employed to make twin, king and queen sized mattresses. The apparatus of said applications utilizes a plurality of clip wrapping tools for simultaneously wrapping clips on the borderwires and the coils of a mattress innerspring to secure the upper and lower borderwires to the mattress innerspring along opposite sides thereof. In a preferred embodiment of the apparatus, four clip wrapping tools are used. With this number of tools, the apparatus can wrap four clips per second on the borderwires and the coils of a mattress innerspring. Sensing means is used to activate the clip wrapping tools as the stacked borderwires and mattress innerspring are advanced by a motor driven pusher along the horizontal support means. The apparatus of said applications further incorporates reciprocatable coil engaging means, and clip feed roll means for the clip wrapping tools. Control means is provided for activating and deactivating the sensing means, and for reversing the direction of the motor driven pusher. The control means may comprise a computer, or a system of relays, or the like, electrical signal generating means.

BRIEF SUMMARY OF THE INVENTION

The apparatus, and method, of the present invention, while achieving the same results as the apparatus, and method, of the aforementioned copending patent applications, attain those results in a unique manner which, like the apparatus and method of said copending applications, makes this invention a significant breakthrough in the mattress innerspring manufacturing industry. The apparatus of the present invention can be fabricated of readily available materials with minimum labor and without the need for specialized equipment. The resulting comparatively low manufacturing cost of the apparatus can, of course, be reflected in the purchase price of the apparatus to the end user. The uncomplicated design and structure of the apparatus make it easy to maintain, and its essentially completely automatic, self-contained control features make it simple to operate. The upright, substantially vertical orientation of the apparatus greatly reduces the amount of floor space required to accommodate it. This feature of the invention can permit two units, for example, to be placed in opposed, side-by-side relation to one another whereby a single operator can use both units thereby doubling his or her production. The upright, substantially vertical orientation of the apparatus has the added advantage of enabling the borderwires and a mattress innerspring supported on the apparatus to properly align themselves thereby eliminating the need for providing special alignment means on the apparatus. The stability of the apparatus is such that it can be operated without the need for anchoring it to a supporting surface. This feature of the apparatus is complemented by its relatively compact, self-contained, lightweight construction which enables it to be moved by hand to another location in a work area when necessary. The apparatus of this invention, like the apparatus disclosed in said copending applications, can be used with equal facility to secure borderwires on mattress innersprings for making twin, as well as king and queen size mattresses.

In brief, the apparatus of the present invention comprises support means adapted to maintain borderwires and a mattress innerspring on edge in a substantially upright position. Clip wrapping means is provided for wrapping clips on the borderwires and the coils of the mattress innerspring along said edge. The borderwires and the mattress innerspring are advanced along the support means in the direction of the clip wrapping means by drive means carried on the support means. Control means is provided for the apparatus for sequentially deactivating the drive means and activating the clip wrapping means to enable clips to be successively wrapped on the borderwires and the mattress innerspring along said edge of the borderwires and the mattress innerspring. Turning means is provided for rotating the borderwires and the mattress innerspring on the support means to present a different edge of the borderwires and mattress innerspring to the clip wrapping means. The turning means automatically rotates the borderwires and the mattress innerspring on the support means until each edge thereof has been advanced through the clip wrapping station. Sensing means is provided to detect the perimetric dimensions of the mattress innerspring and the borderwires during each rotation for automatically positioning the drive means the correct distance from the mattress innerspring and the borderwires. A unique safety feature, which includes a photoelectric cell, is provided for deactivating the drive means in response to any unprogrammed interruption of the movement of the mattress innerspring and borderwires along the support means.

DETAILED DESCRIPTION OF THE INVENTION

Figure 1:
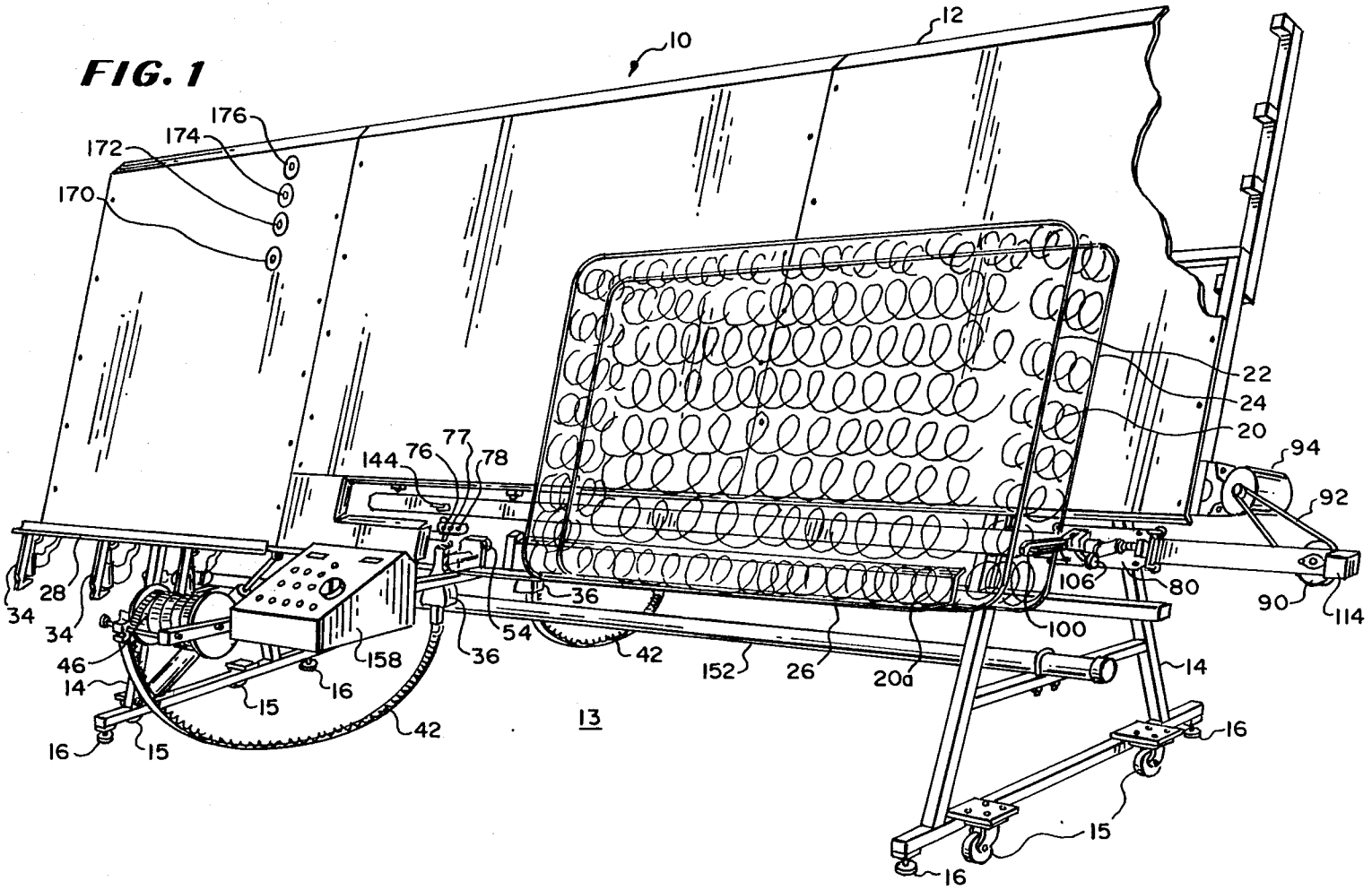
FIG. 1 is a view in perspective of an embodiment of the apparatus of the present invention with a mattress innerspring and borderwires positioned thereon.

The embodiment of the invention illustrated, and designated generally by reference numeral 10, comprises an elongated, generally rectangularly shaped frame member 12 which is maintained in a substantially upright position with relation to a floor surface 13, for example, by support members 14—14. The frame member 12 and the support members 14—14 advantageously are fabricated of hollow bar stock utilizing a minimum number of structural elements consistent with providing a self-supporting, high strength, stable, relatively lightweight unit which can be moved, if necessary, by an operator. In the embodiment of the invention shown, movement of the entire unit advantageously is facilitated by providing casters 15—15on the support members 14—14. Adjustable stabilizers 16—16 desirably are positioned on the members 14—14 to maintain the unit in a preselected position on the floor surface 13 during operation.

Figure 2:
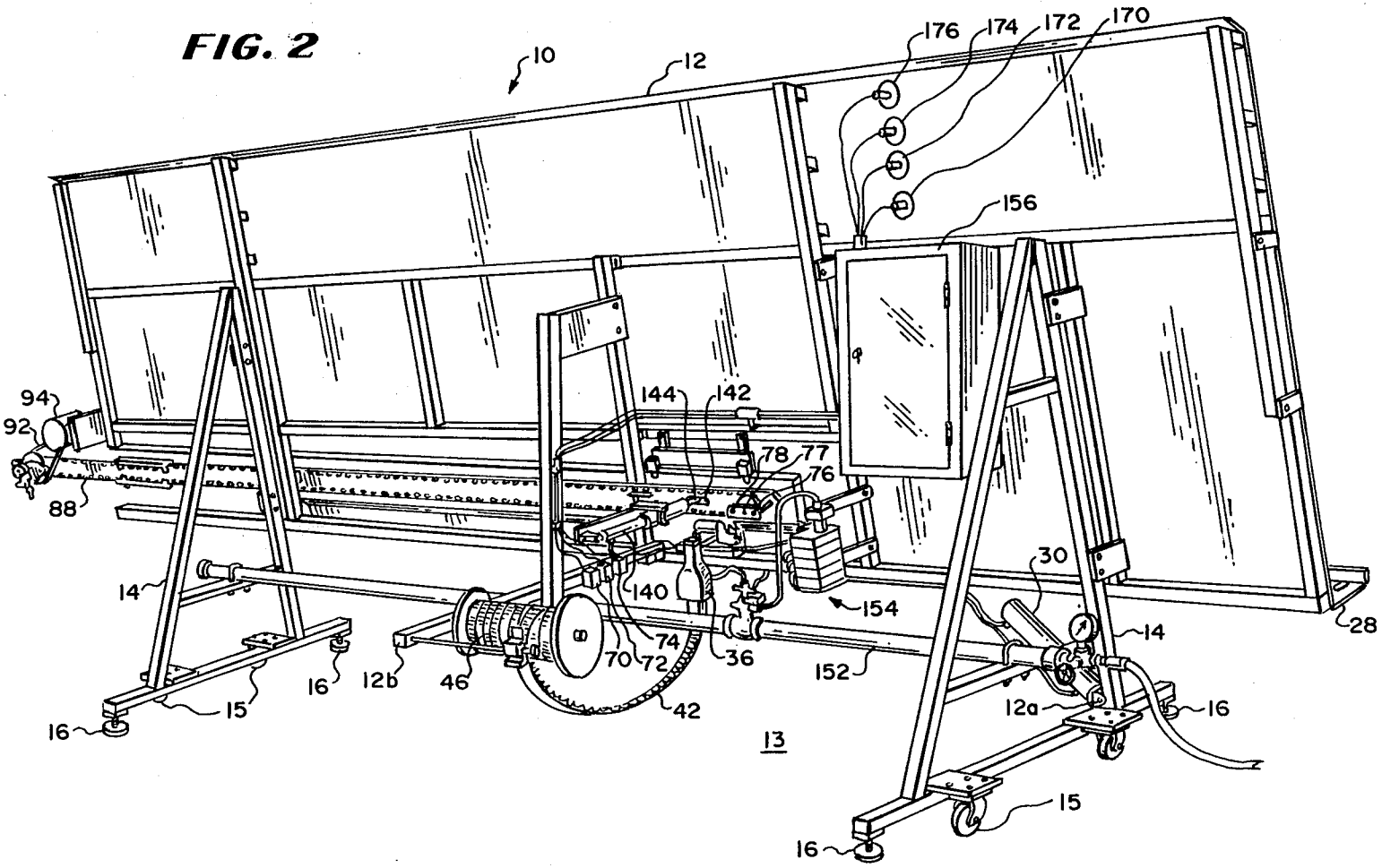
FIG. 2 is a rear view in perspective of said embodiment of the invention.

As best illustrated in FIGS. 1 and 2 of the drawings, the frame member 12 advantageously is tilted rearwardly at an angle of declination of the order of about 15° to vertical, and is provided with a smooth-surfaced skin or facing 18 desirably formed of a thin, lightweight material such as aluminum sheeting or sheet metal. The slight inclination of the frame member 12 maintains the center of gravity of a mattress innerspring 20 and its associated borderwires 22 and 24 in a position such that they will remain in contact with the facing 18 throughout the clip wrapping operation. The facing 18 provides a snag-proof surface along which the mattress innerspring 20 and the borderwires 22 and 24 are advanced as clips are being wrapped on the borderwires and the coils **20*a*** forming the margins of the mattress innerspring, and, also, as the mattress innerspring and the borderwires are rotated on the apparatus as will be described.

Figure 13:
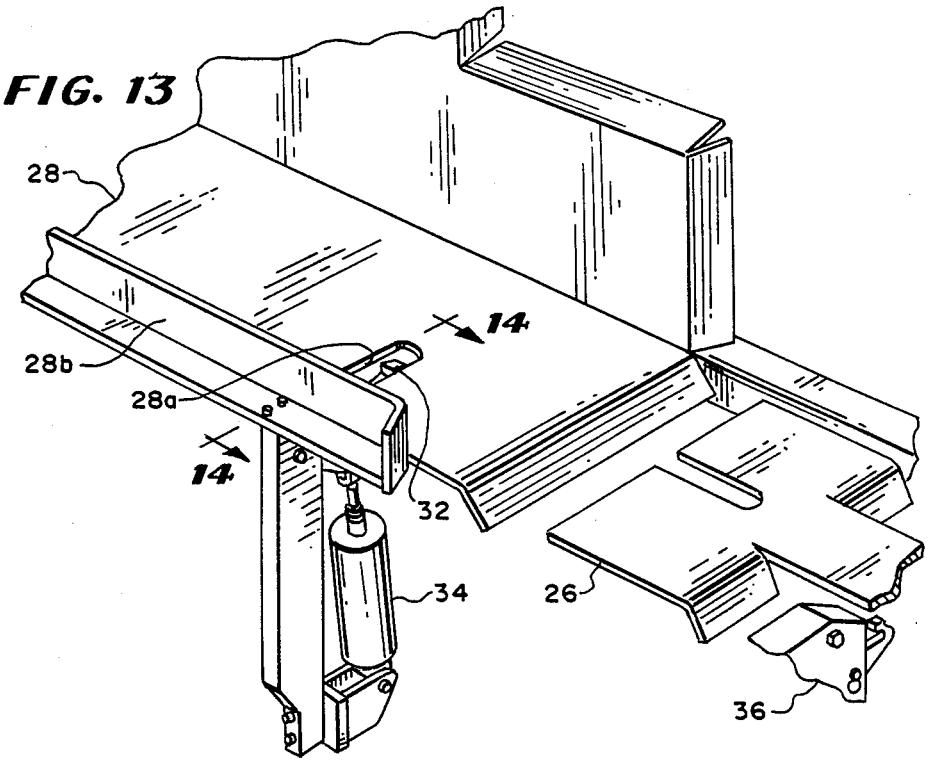
FIGS. 13 through 15 are views of an element of the gripper means associated with the turning or rotating means for engaging a mattress innerspring and borderwires as they are being rotated by the turning or rotating means.
Figure 14:
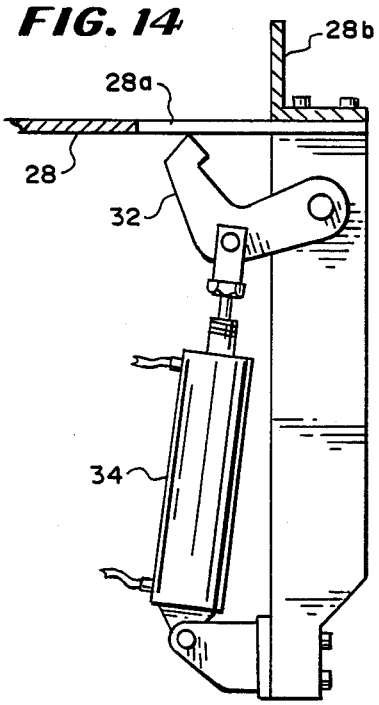
Figure 15:
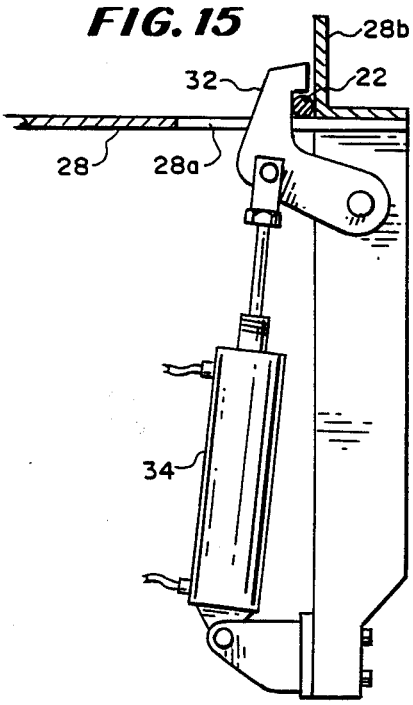
Figure 16:
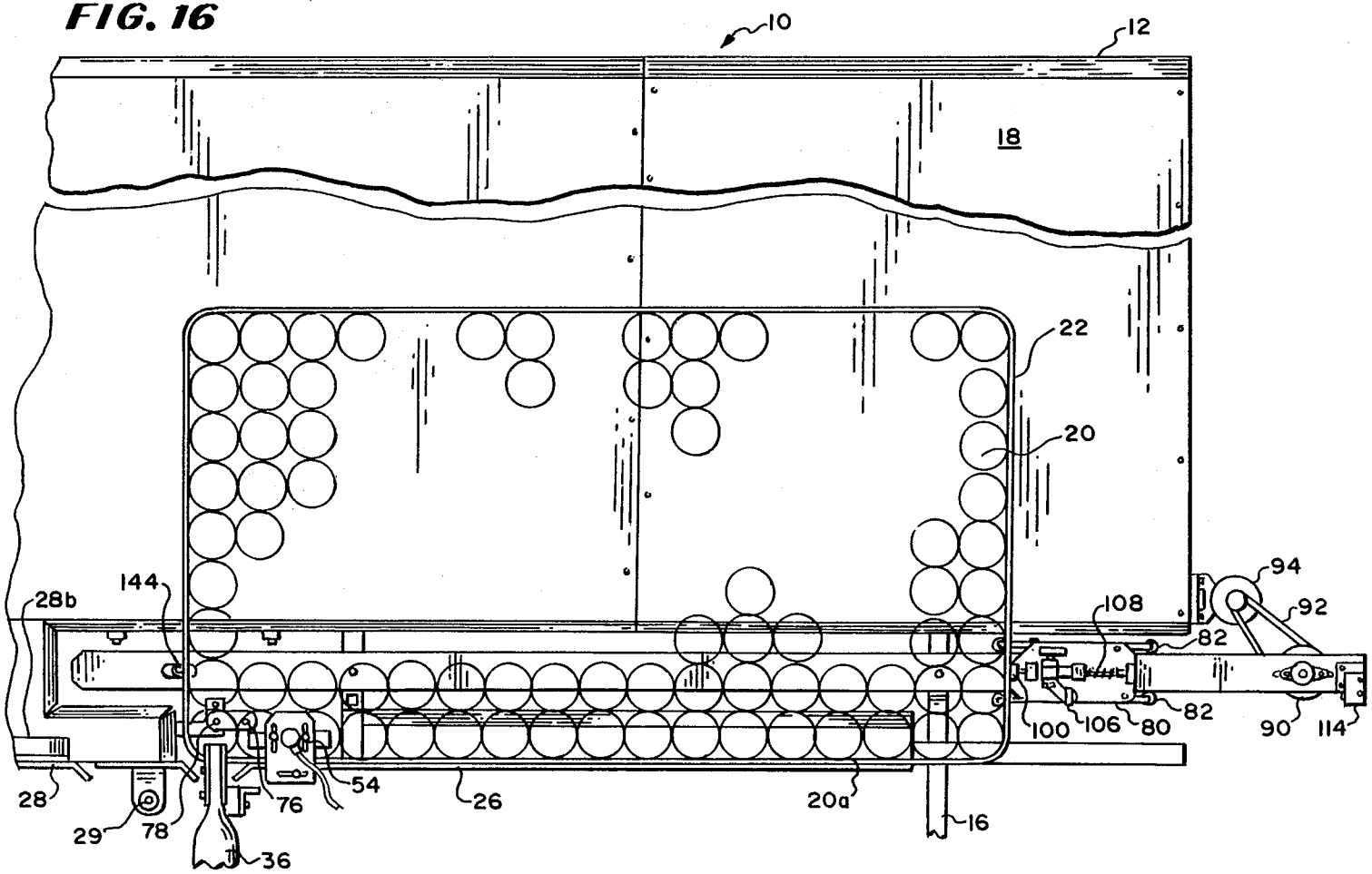
FIG. 16 is a fragmentary frontal view of said embodiment of the apparatus showing a mattress innerspring and borderwires being engaged by the stop means at the clip wrapping station of the apparatus.
Figure 17:
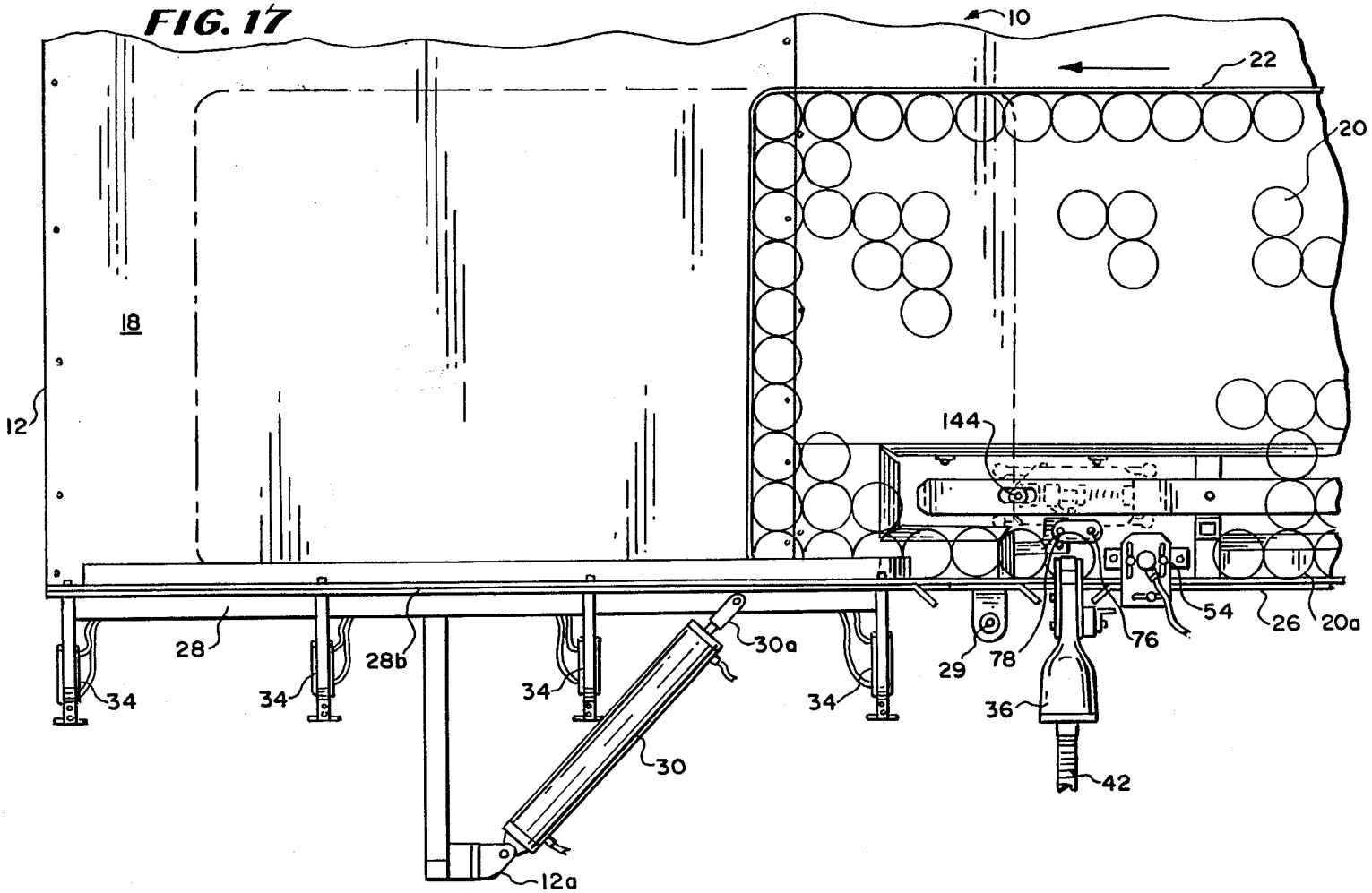
FIG. 17 is a fragmentary frontal view of said embodiment of the apparatus showing a mattress innerspring and borderwires being advanced through the clip wrapping station into the rotation zone.
Figure 18:
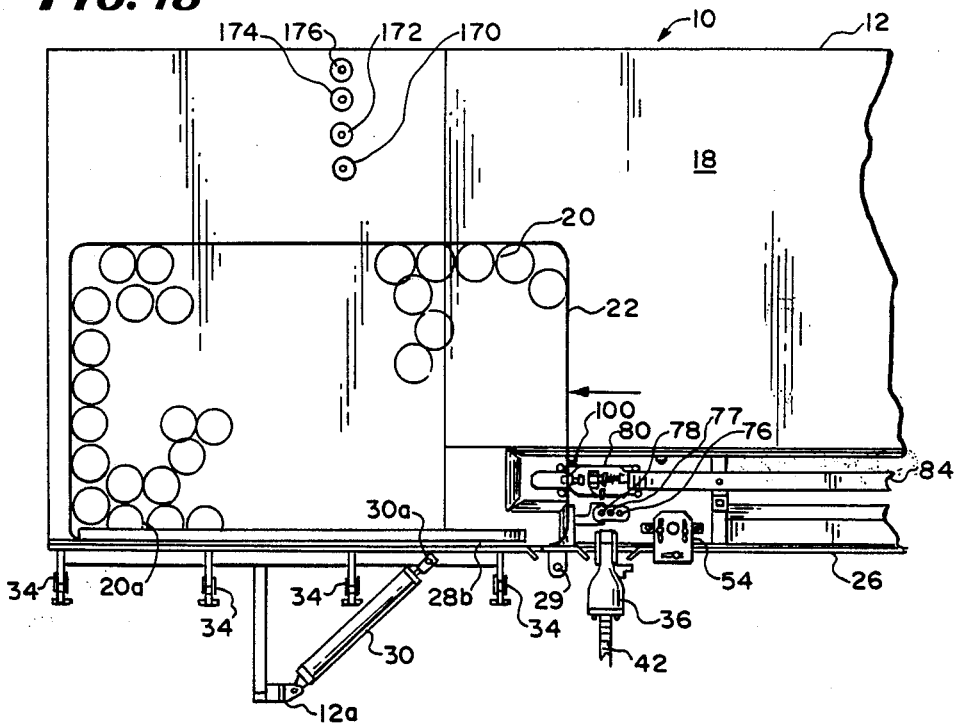
FIGS. 18 and 19 are fragmentary frontal views showing a mattress innerspring and borderwires in the rotation zone and being rotated at that zone.
Figure 19:
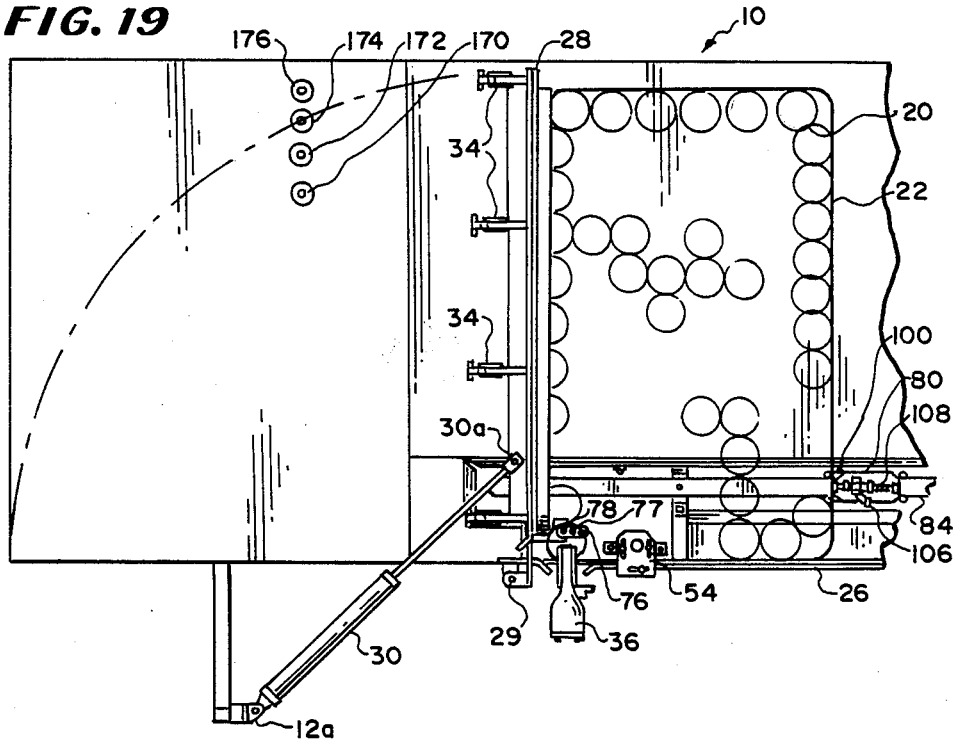

The front of the frame member 12 is provided with an outwardly, extending relatively narrow ledge or platform 26 on which an edge of the mattress innerspring 20 and the borderwires 22 and 24 ride as they are advanced in the direction of the clip wrapping station of the apparatus. The front of the frame member 12 also is provided with a paddle-like member 28 which lies in substantially the same plane as the ledge or platform 26, and is mounted for rotation on a pivot pin 29 carried on the frame 12 (see FIG. 16). In the embodiment of the invention shown, rotation of the paddle-like member 28 desirably is achieved by means of an air cylinder 30, the lower end of the piston housing of which is pivotally mounted to an extension **12*a* of the frame member 12, while the free end of the piston rod 30*a* of which is pivotally secured to the paddle-like member 28 (see FIGS. 17, 18 and 19). The paddle-like member 28 advantageously is provided with a plurality of spaced, transverse slots 28*a* through each of which a gripper 32 extends when rotated by an air cylinder 34 (See FIGS. 13, 14 and 15). The grippers 32 are activated when an edge of a mattress innerspring and the borderwires have passed through the clip wrapping station, and have been advanced onto the paddle-like member 28 to be rotated through an angle of 90° to position another, unclipped edge of the mattress innerspring and the borderwires on the ledge or platform 26 (see FIGS. 18 and 19). The grippers 32, when activated, engage the coils and the borderwires, at spaced intervals, and hold them rigidly against an upwardly extending guide member 28*b* provided on the paddle-like member 28**.

Figure 5:
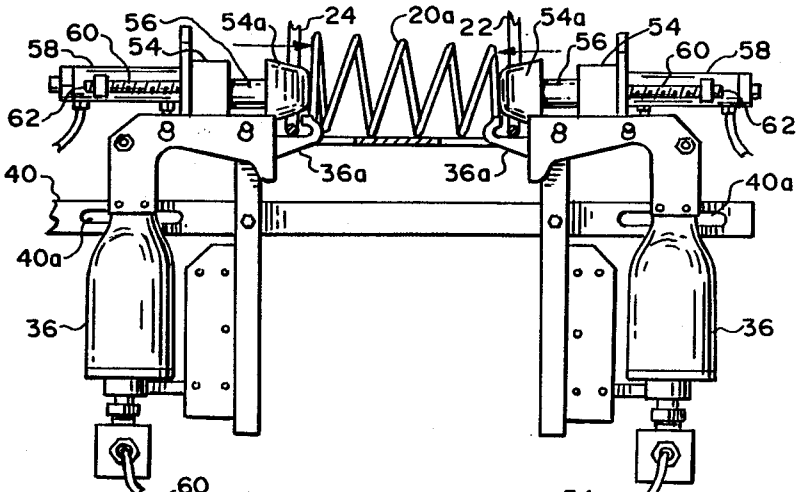
FIG. 5 is an enlarged fragmentary sectional view taken substantially along line 5—5 of FIG. 4.
Figure 4:
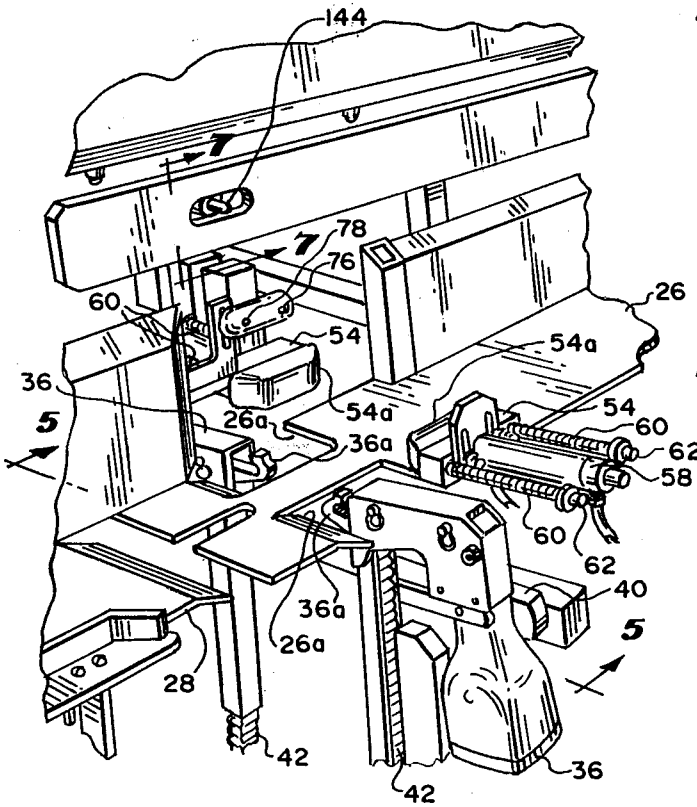
FIG. 4 is a fragmentary view of the clip wrapping station of said embodiment of the apparatus.

As best illustrated in FIGS. 4 and 5 of the drawings, the clip wrapping station of the apparatus comprises a pair of clip wrapping tools 36—36 which are movably mounted on a slotted bar 40 secured to the frame member 12. The clip wrapping tools 36—36 are of a type similar to the clip wrapping tool disclosed in U.S. Pat. No. 4,546,528, and in co-pending U.S. patent application Ser. No. 944,561, now U.S. Pat No. 4,724,590, dated Feb. 16, 1988, in that each comprises a housing connected to a source of air under pressure for driving a reciprocatable blade or plunger which sequentially severs clips from lines 42—42 of interconnected clips spirally wound on feed rolls 46—46 rotatably supported on a bar **12*b* secured to the frame member 12 (see FIGS. 1 and 2**). A preferred form of the clips and the feed rolls are disclosed in U.S. Pat. No. 4,508,220.

Each of the tools 36—36 has an anvil or forming jaw **36*a* for cradling the borderwires 22 and 24, and the coils 20*a* which form the margins of the mattress innerspring 20 (see FIG. 5). As best shown, in FIG. 4, the forming jaws 36*a* of the tools 36—36 are positioned in opposed relation to one another in recesses 26*a*—26*a* formed adjacent to the inner end of the ledge or platform 26. The slots 40*a* in the bar 40 on which the tools 36—36** are movably mounted enable adjustment of the tools toward and away from each other to accommodate mattress innersprings of different thicknesses.

Figure 6:
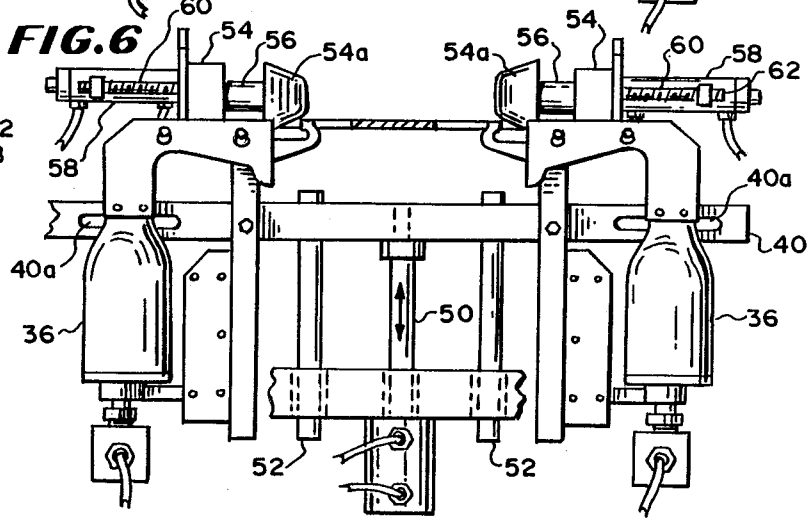
FIG. 6 is a view corresponding to the view of FIG. 5 showing a modification of the clip wrapping station.

In FIG. 6 of the drawings, a variation of the mounting of the tools 36—36 on the frame member 12 is illustrated. In the embodiment shown, the slotted bar 40 is connected to the piston rod of an air cylinder 50. A pair of guide pins 52—52 serve to assure precise reciprocatable movement of the tools 36—36 with relation to the coils of a mattress innerspring. This arrangement has special applicability to a mattress innerspring formed of continuous coils having lengths such that they have to be severed at their ends to provide a mattress innerspring of desired dimensions. The severed portions of the coils require that the forming jaws of the clip wrapping tools be positioned below the severed portions of the coils while the mattress innerspring is in motion, and for the clip wrapping tools to move reciprocatably with relation to each coil of the mattress innerspring to enable clips to be properly secured on the coils and the borderwires.

Referring, again, to FIGS. 4 and 5 of the drawings, a pair of coil engaging members 54—54 ar positioned in opposed relation to one another along the ledge or platform 26 adjacent to the clip wrapping tools 36—36 . As shown, each of the members 54—54 has a reciprocatable coil engaging head portion 54*a* secured to the end of the piston rod 56 of an air cylinder 58. Each of the members 54—54 also is provided with a pair of compression springs 60—60 which are carried on rods 62—62, the inner ends of which are secured in the head portion 54*a* of each of the members 54—54. The head portion 54*a* of the members 54—54 act in unison to depress the coils 20*a* of a mattress innerspring inwardly (see FIG. 5) to position the coils in proper alignment with the borderwires 22 and 24 during each clip wrapping operation of the tools 36—36. The air cylinders 58 are in synchronous operation with the tools 36—36 so that the head portions, 54*a* only come into contact with the coils 20*a* when the tools 36—36 are activated. The compression springs 62—62 return the head portions 54*a* to their normal retracted position each time the members 54—54 and the tools 36—36 are deactivated.

Figure 3:
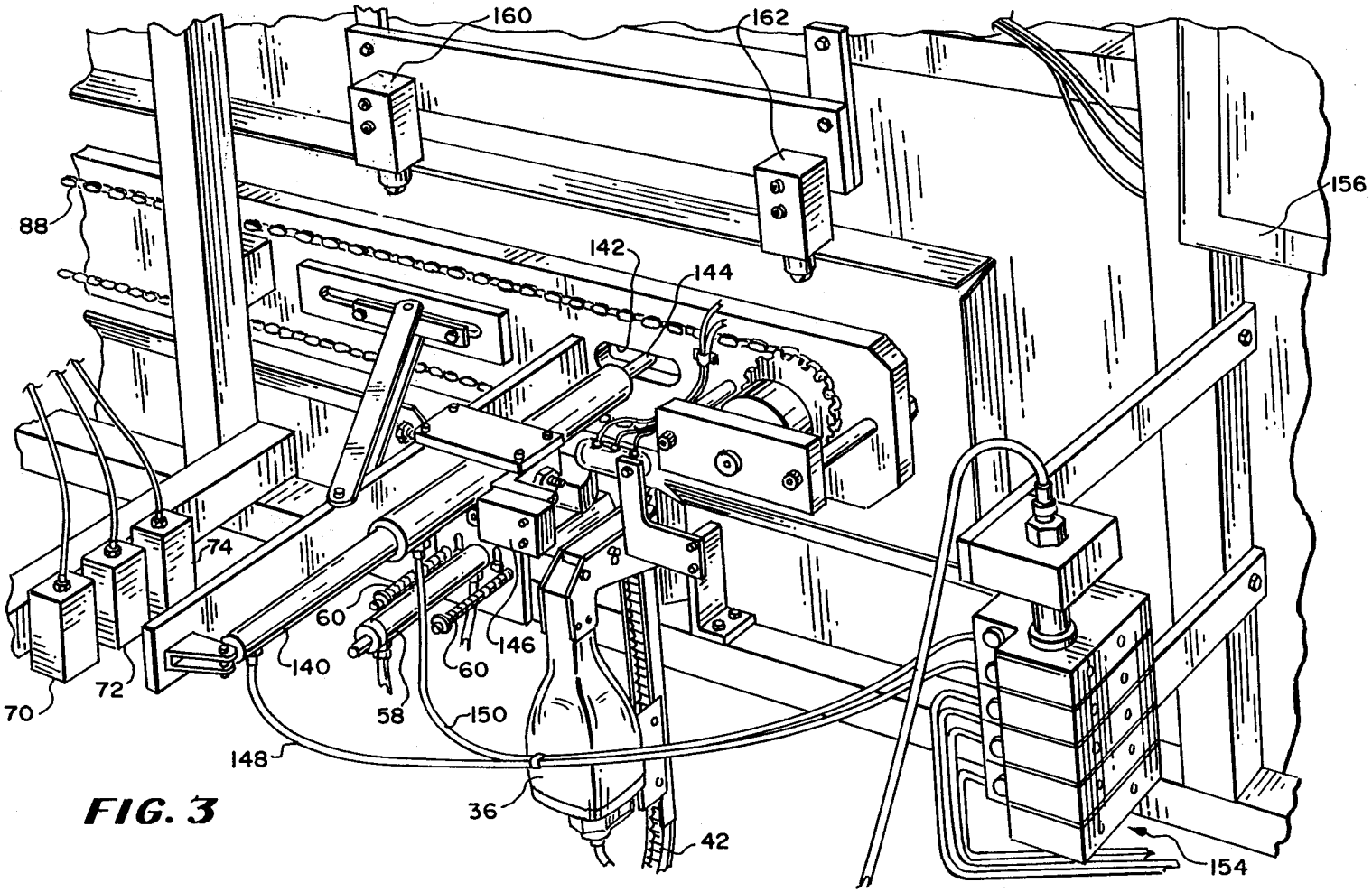
FIG. 3 is a fragmentary view in elevation of a portion of the back of said embodiment of the apparatus showing various of the control components of the apparatus.

The clip wrapping station of the apparatus includes sensing means advantageously in the form of fiber optic switches 70, 72 and 74, and their associated optic elements 76, 77 and 78 (see FIGS. 3 and 4). The switches 72 and 74 are connected in series and act in unison. The optic elements 76, 77 and 78 are positioned on the frame member 12 at a point above the coil engaging member 54 located adjacent to the inner margin of the ledge or platform 26. The element 76 senses the end coils of a mattress innerspring, while the elements 77 and 78 sense the side coils of the mattress innerspring. The elements 76, 77 and 78 act to accurately and consistently send signals to the switches 70, 72 and 74 when the coils are in a clip wrapping position. The switches 70, 72 and 74, in turn, activate control means for the clip wrapping tools 36—36 and the coil engaging members 54—54.

In the embodiment of the apparatus illustrated, the advance of the mattress innerspring 20 and the borderwires 22 and 24 in the direction of the clip wrapping station advantageously is achieved by means of a motor driven carriage 80. The carriage 80 is generally U-shaped in configuration, and is provided with a plurality of rollers 82 which ride along the upper and lower margins, and the inner wall of a guide plate 84 positioned on the frame member 12 at substantially a right angle with relation to the upper surface of the ledge or platform 26. The carriage 80 is engaged by means of pins 86 on an endless chain 88 driven by a sprocket carried on a shaft on which a pulley 90 is mounted. The pulley 90 is driven by a belt 92 connected to a pulley mounted on the shaft of a motor 94 secured to the frame member 12 (see FIG. 2). The motor 94 is provided with a brake and a clutch for controlling the forward and reverse movement of the carriage 80 along the guide plate 84.

Figure 9:
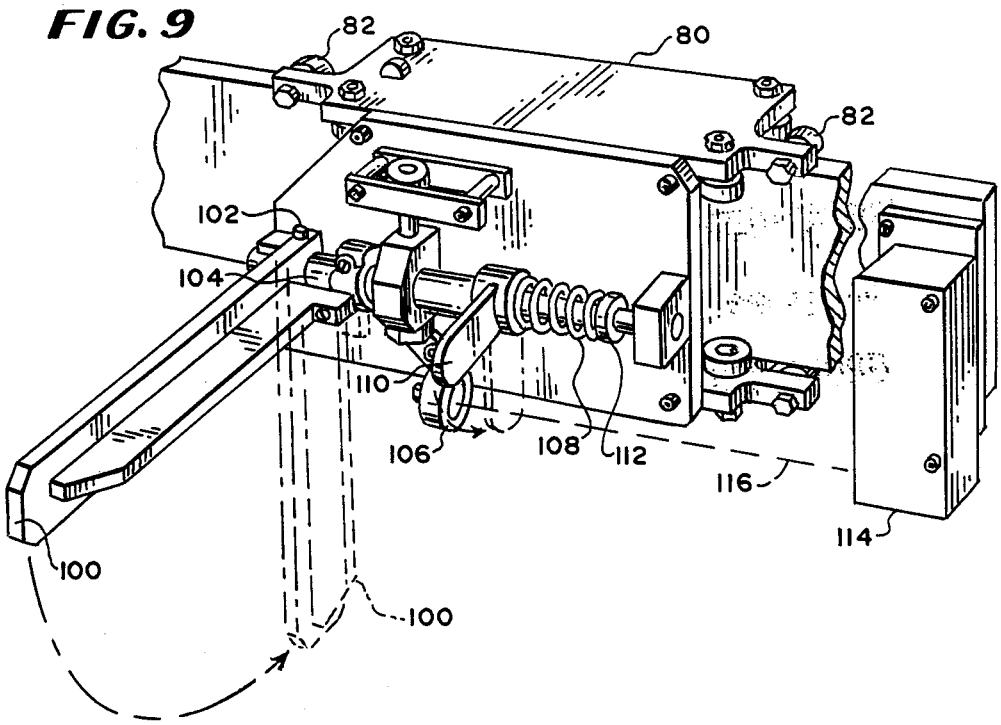
FIG. 9 is a fragmentary view in perspective of the unique safety means carried on the carriage means of said embodiment of the invention.
Figure 11:
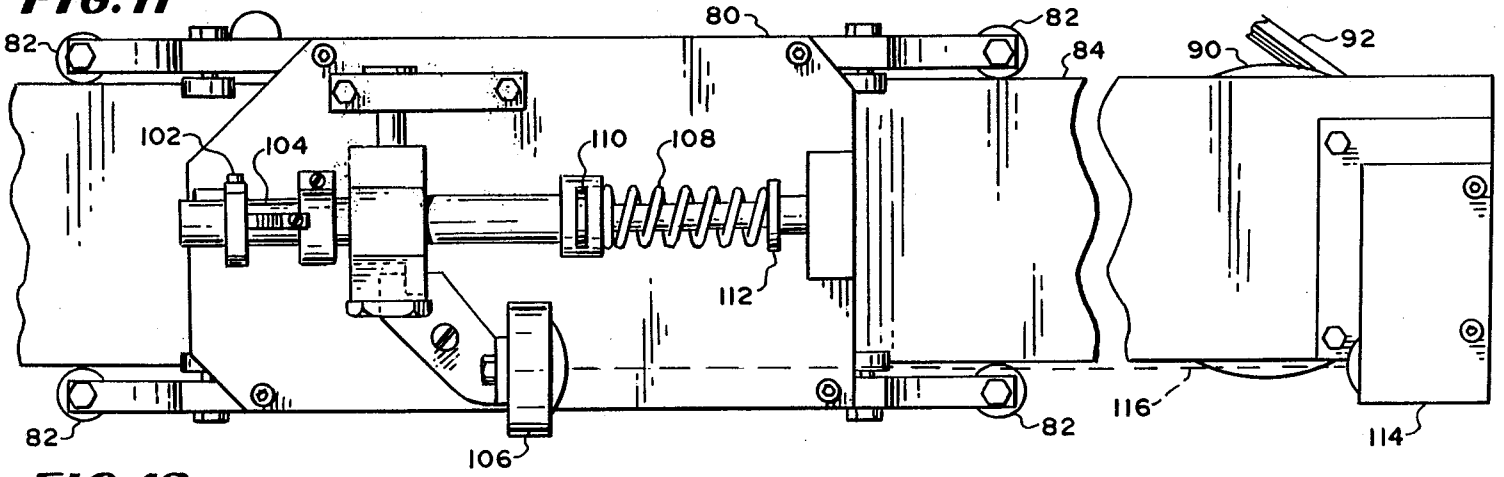
FIGS. 11 and 12 are top plan views of the safety means on the carriage means showing it in its normal position in FIG. 11 and its carriage deactivating position in FIG. 12.
Figure 12:
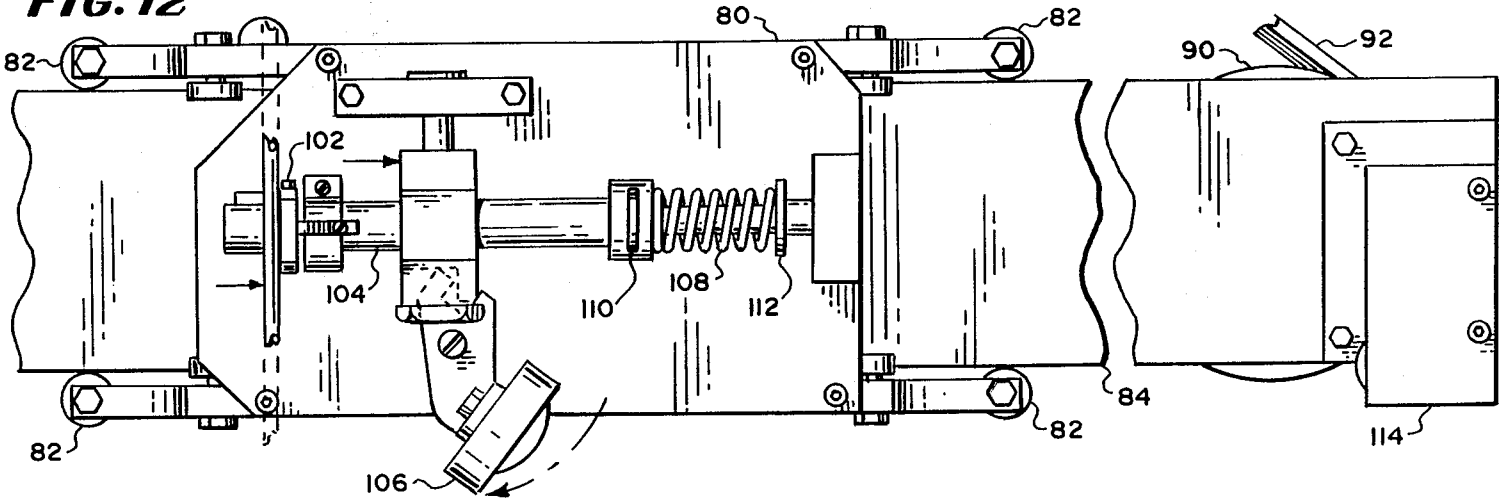

As shown in FIG. 9, the carriage 80 has an outwardly extending pusher bar 100 which is adapted to contact a mattress innerspring and borderwires as they are advanced by the carriage 80, while in a substantially upright position as shown in FIG. 1, along the ledge or platform 26 in the direction of the clip wrapping station. The pusher bar 100 desirably is mounted by means of a set screw 102 on a rotatable rod 104 on which is secured a pivotable reflector 106. The rod 104 also carries a compression spring 108 positioned between an arm member 110 and a washer 112 carried on the rod 104. A photoelectric cell 114, mounted at the end of the frame member 12, transmits a beam 116 which is intercepted by the reflector 106. The reflector 106 and the cell 114 comprise a unique safety device for stopping the advance of the carriage 80 when the mattress innerspring and the borderwires encounter an unprogrammed interruption either as they are advanced along the ledge or platform 26 in the direction of the clip wrapping station, or when they may, for some reason, tilt or fall against the pusher bar 100. Thus, referring first to FIGS. 11 and 12, the reflector 106 and the photoelectric cell 114 are shown in FIG. 11 in their normal position during advance of the carriage 80 in the direction of the clip wrapping station. When the advance of the mattress innerspring and the borderwires experiences an unprogrammed interruption, the pusher bar 100 and the rod 102 move rearwardly against the action of the compression spring 108 causing the reflector 106 to pivot outwardly as shown in FIG. 12 thereby interrupting the beam 116 emitted by the cell 114. Interruption of the beam 116 deactivates the motor 94, stopping the carriage 80. The other contingency the safety device is intended to meet is, as indicated above, the situation where the mattress innerspring and the borderwires may be caused to tilt against the pusher bar 100. As shown in FIG. 9, when for some reason, this occurs, the pusher bar 100 is rotated downwardly. At the same time, the arm member 110 is rotated downwardly to a position in front of the reflector 106 causing the beam 116 to be interrupted and the motor 94 to be deactivated. A detent formed on the rod 104 serves to maintain the pusher bar 100 in its normal, outwardly extended position when it is in contact with a mattress innerspring and borderwires being advanced along the ledge or platform 2 by the carriage 80.

Figure 10:
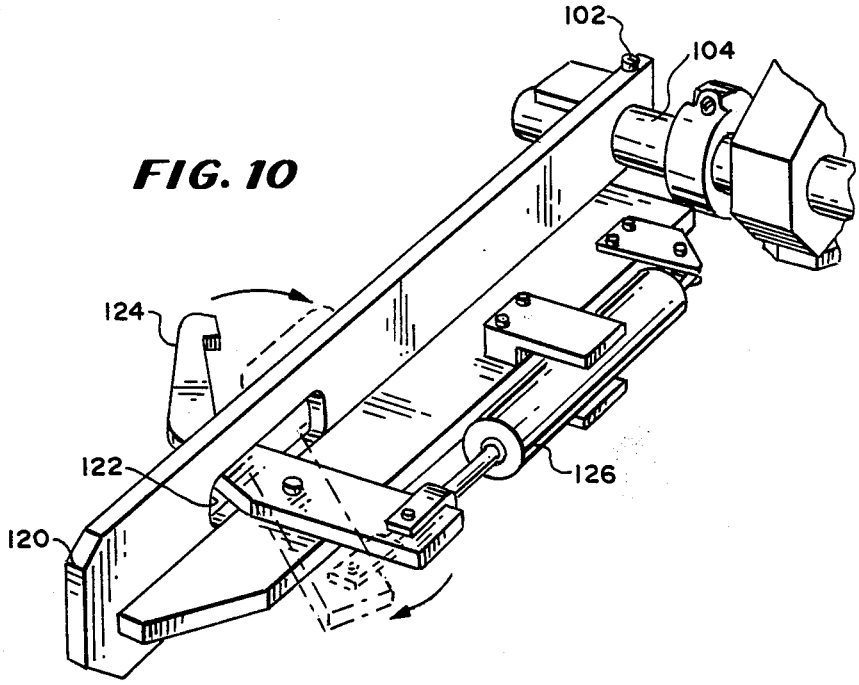
FIG. 10 is a fragmentary view in perspective of a modification of the carriage means showing clamp means for engaging a mattress innerspring as it is advanced toward the clip wrapping station of the apparatus.

In FIG. 10, a modification of the pusher bar is illustrated. As shown, the bar 120 is provided with a slot 122 through which a pivotally mounted gripper member 124 extends. The member 124 is adapted to engage the coils at the rear of a mattress innerspring as it is being advanced toward the clip wrapping station. The coil gripping action of the member 124 desirably is controlled by a programmed air cylinder 126 secured to the pusher bar 120. This arrangement acts to overcome inertial stresses as a mattress innerspring and the borderwires move along the ledge or platform 26, and has special utility in those instances where large sized mattress innersprings are being processed on the apparatus.

Figures 7, 8:
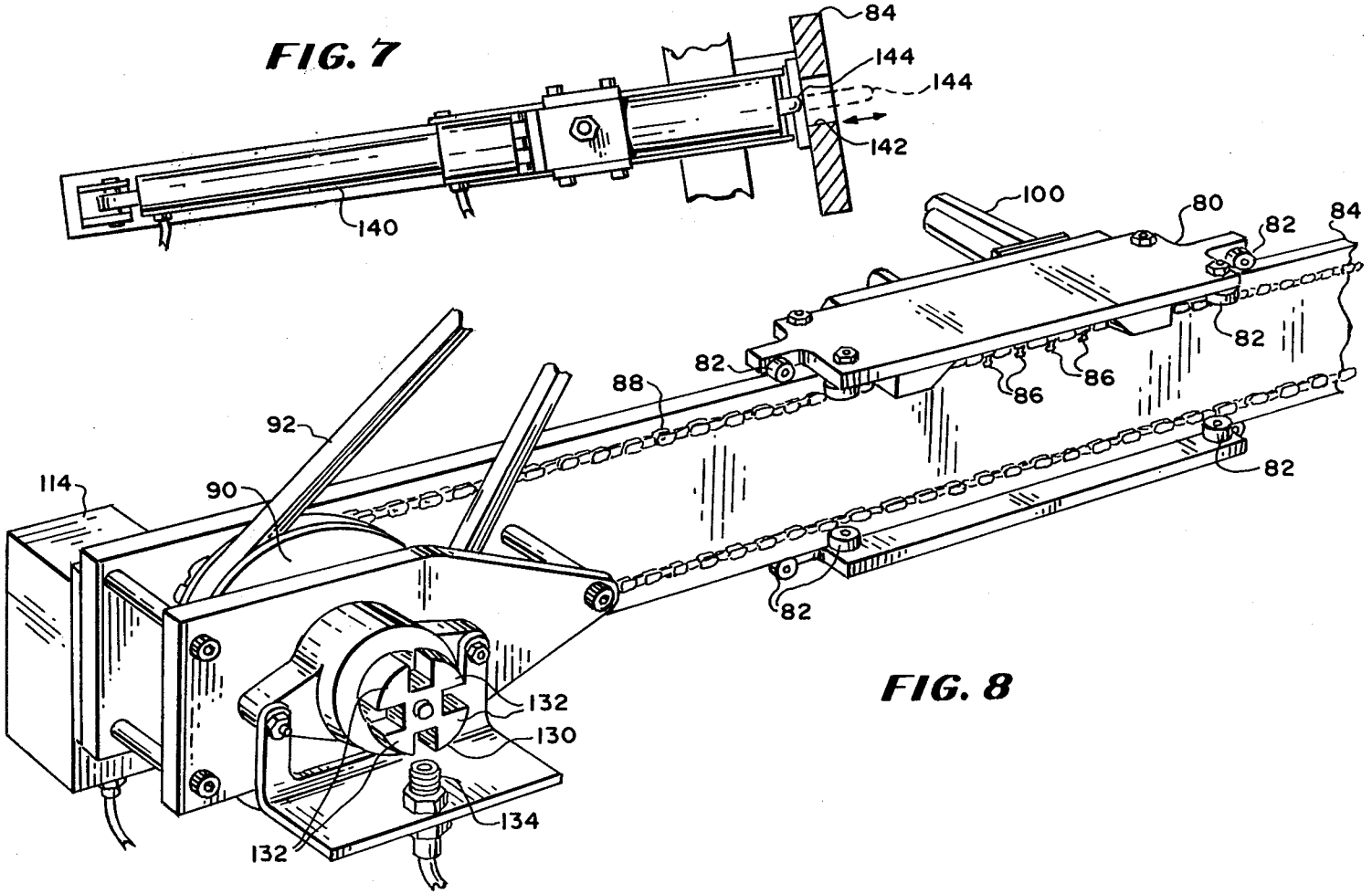
FIG. 7 is a top plan view in elevation of an embodiment of the stop means of the apparatus.
FIG. 8 is a fragmentary view in perspective of the carriage means and components of its associated drive means.

Referring to FIG. 8, a disc member 130 is shown mounted on the shaft on which the pulley 90 is mounted. The disc member 130 is formed with spaced radial portions 132 which in cooperation with a non-contact solid state sensor 134 comprise a proximity switch. The switch counts the shaft rotations whereby the carriage 80 will travel the proper distance in reverse after each successive rotation of a mattress spring and borderwires on the apparatus.

As best shown in FIGS. 3 and 7, retractable stop means advantageously is provided for the apparatus to establish a reference point with respect to the coils of a mattress innerspring as it and the borderwires enter the clip wrapping station upon each rotation of the mattress innerspring and the borderwires. In the embodiment of the apparatus illustrated, the stop means comprises an air cylinder 140 which is adjustably mounted on the rear of the frame member 12. A slot 142 is formed in the guide plate 84 for enabling the reciprocatable tip 144 of the piston rod of the cylinder 140 to make contact with the leading edges of a mattress innerspring and borderwires as they enter the clip wrapping station (see FIG. 16). The cylinder 140 is associated with a limit switch 146 which is activated when the lead end of the mattress innerspring and the borderwires make contact with the tip 144 of the piston rod of the cylinder 140. The cylinder 140 is connected by conduits 148 and 150 to a pneumatic solenoid valve which is in communication with a source 152 of air under pressure (see FIGS. 1 and 2). The solenoid valve is one of a bank of similar valves, designated generally by reference numeral 154, the function of which will become clear as the description proceeds (see FIG. 3). The apparatus also is provided with a main control panel 156 which is mounted on the rear of the frame member 12 (see FIG. 2), and an operator panel 158 mounted on the front of the frame member 12 (see FIG. 1).

Figure 20:
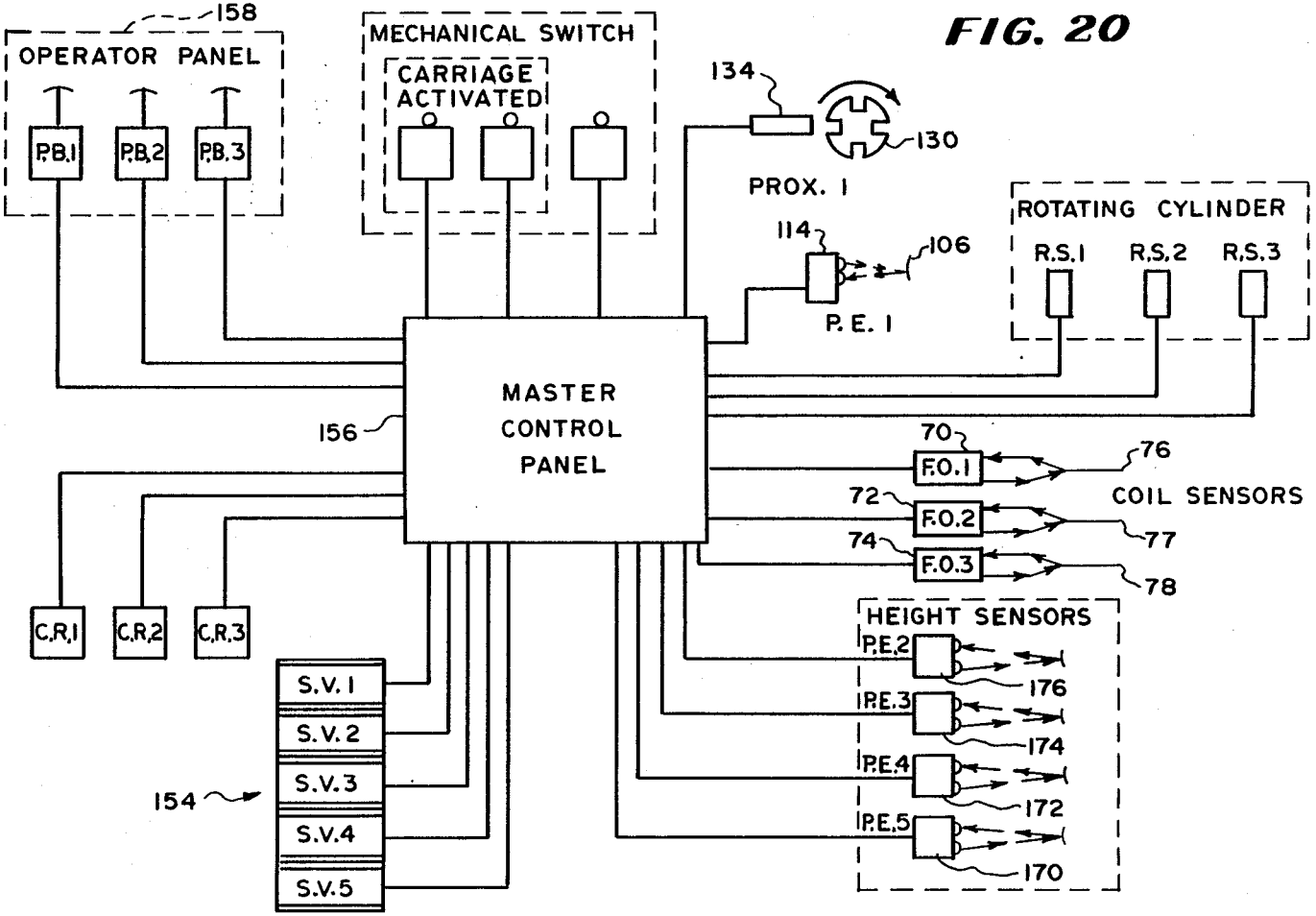
FIG. 20 is a flow diagram showing the sequence of operations carried out by the apparatus.

In FIG. 20, the sequence of steps involved in securing borderwires on a mattress innerspring with the apparatus of the present invention is schematically illustrated in block form. With the carriage 80 in its fully retracted position, an operator places a mattress innerspring and borderwires on the ledge or platform 26, on edge, in a substantially upright position. The angle of declination from vertical of the facing or skin 18 of the frame member 12 causes the mattress innerspring and the borderwires to rest against the facing or skin and prevents them from tipping in a direction which otherwise may shift their center of gravity beyond the outer edge of the ledge or platform 26. In order to assure proper alignment of the borderwires with relation to the coils along the margins of the mattress innerspring, the operator desirably initially manually wraps clips on all four corners of the stacked elements. After positioning the mattress innerspring and the borderwires on the apparatus, the operator then presses the start button on the operator panel 158. The carriage 80 advances the leading edge of the mattress innerspring and the borderwires to the stop means where they make contact with the retractable tip 144 of the air cylinder 140 (see FIG. 16). The tip 144 retracts and the coil sensors 76, 77 and 78 are enabled. The carriage 80 then advances the mattress innerspring and the borderwires into the clip wrapping station. When the coil sensors "see" a coil, the carriage 80 is momentarily stopped, and the clip wrapping tools 36—36 and the coil engaging members 54—54 are activated. After clips have been wrapped on the coils and the borderwires, the clip wrapping tools and the separators are deactivated. This sequence is repeated until clips have been wrapped along an entire edge of the mattress innerspring and the borderwires.

When the last clip has been wrapped, on the edge of the mattress innerspring and the borderwires supported on the ledge or platform 26, a limit switch or end-clip switch, designated by reference numeral 160, (See FIG. 3) is activated and the coil sensors 76, 77 and 78 are disabled. The carriage 80 advances the mattress innerspring and the borderwires to a limit switch 162 (see FIG. 3) which, when activated, reverses the travel of the carriage 80, and activates the grippers 32 positioned along the paddle-like member 28, and the air cylinder 30 for rotating the mattress innerspring and the borderwires. The paddle-like member 30 is then rotated through a 90° angle, and an unclipped edge of the mattress innerspring and the borderwires come to rest on the ledge or platform 26 (see FIG. 19). As illustrated in FIGS. 1 and 2, four sensors 170, 172, 174 and 176 are positioned on the frame member 12. One, or more, depending upon the dimensions of the mattress innerspring and the borderwires, of these "height" sensors are activated by the mattress innerspring and the borderwires as they are in the clip wrapping sequence. Energization of the sensors 170, 172, 174 and/or 176 activates the carriage 80, causing it to travel to a point along the ledge or platform 26 a sufficient distance to accommodate the next edge of the mattress innerspring and the borderwires to be wrapped with clips. The paddle-like member 28 then returns to its normal position, and the stop pin 144 is extended. The carriage 80 is again reactivated, and the clip wrapping sequence, and the rotation of the mattress innerspring and the borderwires by the paddle-like member 28 are repeated until clips have been wrapped on each side of all four edges of the mattress innerspring and the borderwires. When the clipping operation has been completed, the clipped unit is removed and transferred to storage for shipment.

Figure 21:
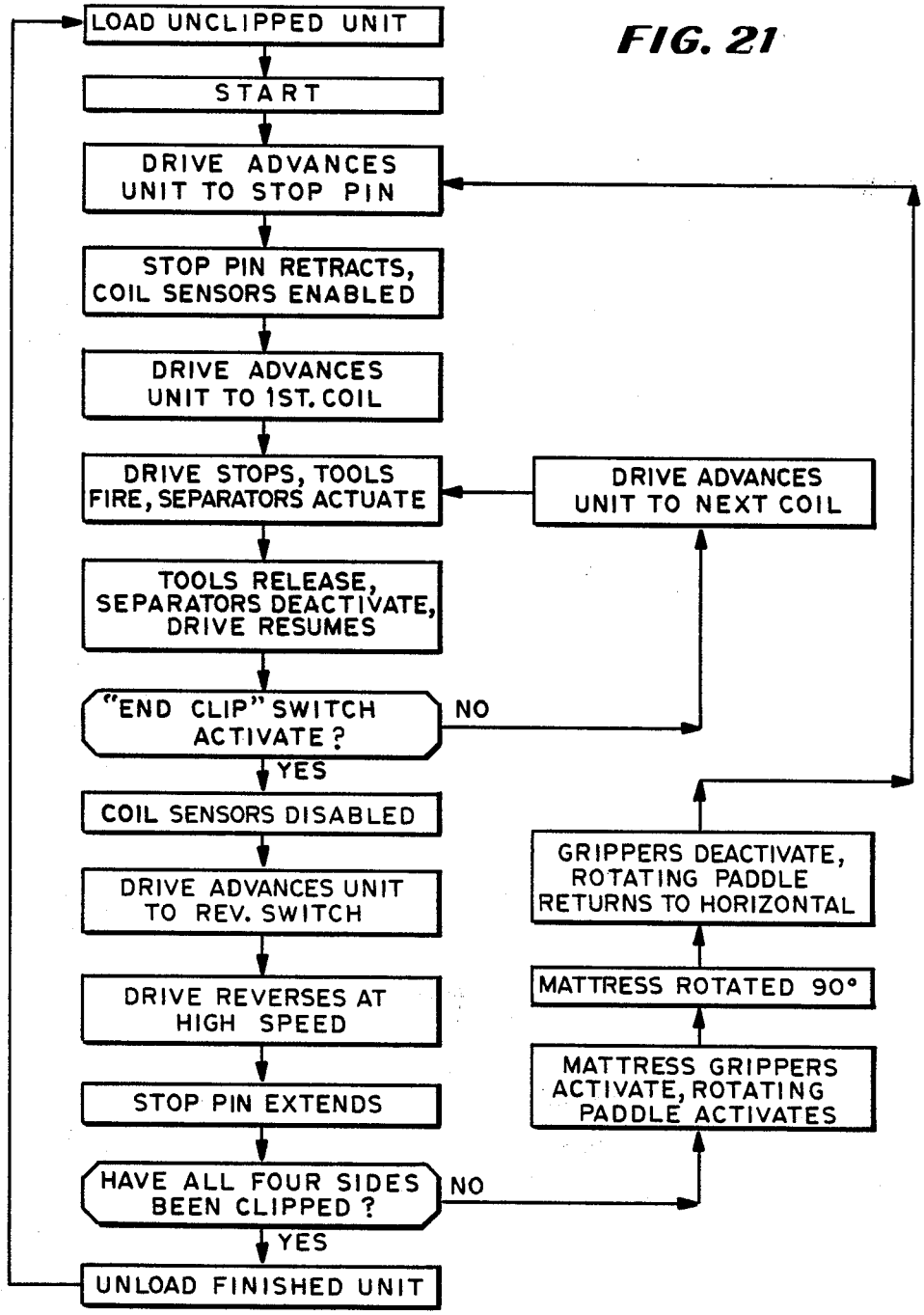
FIG. 21 is a schematic logic circuit diagram of an embodiment of the control means for carrying out the various operations of the apparatus as illustrated in FIG. 20.

In FIG. 21, an embodiment of a control system for the apparatus is schematically shown. The operator panel 158 has a start-cycle switch designated P.B. 1, a stop cycle switch, P.B. 2, and a recycle switch P.B. 3. Relays, designated C.R. 1, C.R. 2 and C.R. 3, are provided for intermittently stopping and starting the carriage 80, causing the carriage to move forward, and causing the carriage to reverse its direction of travel, respectively, Mechanical switches, in the form of limit switches identified as L.S. 1, L.S. 2 and L.S. 3 are provided for, respectively, to disable the sensors 76, 77 and 78; to reverse the travel of the carriage 80; to activate the grippers 32 on the paddle-like member 28, and the paddle-like member 28 itself; and to activate the retractable stop means 140. The fiber optic sensors 70, 72 and 74, designated as F.O.1, and F.O.2 and F.O.3, sense the side coils on a mattress innerspring, and the end coils thereof, respectively. The bank of pneumatic solenoid valves 154 advantageously includes five members designated S.V. 1, S.V. 2, S.V. 3, S.V. 4 and S.V.5. Valve S.V. 1 activates the clip wrapping tools 36—36. Valve S.V. 2 activates the coil engaging members 54—54. Valve S.V. 3 activates the paddle-like member 28. Valve S.V. 4 activates the stop means 140. Valve S.V. 5 restricts the speed at which the air cylinder 30 for the paddle-like member 28 is exhausted and thus has a cushioning effect. The switches, otherwise known as Reed switches, and designated R.S. 1, R.S. 2 and R.S. 3 act, respectively, to terminate the stroke of the air cylinder 30 for rotating the paddle-like member 28 thereby stopping rotation of the mattress innerspring and the borderwires, and deactivating the grippers 32; to restrict the exhaust of the forward stroke of the air cylinder 30; and to restrict the reverse stroke of said cylinder. The "height" sensors 170, 172, 174 and 176 identified as P.E. 2, P.E. 3, P.E. 4 and P.E. 5 in FIG. 21, as stated above, are activated in accordance with the perimetric dimensions of the mattress innerspring and the borderwires, and cause the carriage 80 to travel a predetermined distance in reverse. The photoelectric eye 114, designated as P.E. 1, is a component of the safety feature provided on the carriage 80, and the proximity switch, which comprises the disc 130 and the non-contact sensor 134, identified as PROX. 1, serves to count the shaft rotations of the motor 94 for predetermining the proper travel in reverse of the carriage 80 to accommodate an unclipped edge of the mattress innerspring and the borderwires.

It should be understood that various modifications may be made in the embodiment of the invention illustrated and described without deviating from the basic and broad aspects of the invention.

What is claimed:

1. Apparatus for automatically securing borderwires on mattress innersprings, comprising: mattress innerspring and borderwire support means on which a mattress innerspring, having borderwires positioned in opposed relation on opposite sides thereof, is supported on edge in a substantially unright position; clip wrapping means positioned adjacent to said support means for wrapping clips on the borderwires and the coils of the mattress innerspring along said edge to secure the borderwires to the mattress innerspring; drive means for advancing the mattress innerspring and the borderwires along the support means in the direction of the clip wrapping means; control means for sequentially deactivating the drive means and activating the clip wrapping means whereby the coils of the mattress innerspring are successively secured to the borderwires along said edge thereof, and movable means for sequentially turning the mattress innerspring and the borderwires while the mattress innerspring and the borderwires are in said substantially upright position to present a different edge of the mattress innerspring and the borderwires to said clip wrapping means until the coils of the mattress innerspring are secured to the borderwires along each edge of the mattress innerspring.

2. Apparatus according to claim 1 wherein control means is provided for said movable means for sequentially turning the mattress innerspring and the borderwires on the support means until clips have been wrapped along each edge of the mattress innerspring and the borderwires.

3. Apparatus according to claim 2 wherein said control means includes switch means for deactivating the drive means when clips have been wrapped along all edges of the mattress innerspring and the borderwires.

4. Apparatus according to claim 1 wherein the clip wrapping means is adjustable to enable said means to accommodate mattress innersprings of different thicknesses and construction.

5. Apparatus according to claim 1 wherein mattress innerspring coil engaging means is provided along the support means for aligning the coils of the mattress innerspring with the borderwires during activation of the clip wrapping means.

6. Apparatus according to claim 1 wherein the drive means comprises a motor operatively connected to a movable carriage provided with gripper means for engaging the rear end of a mattress innerspring and borderwires supported on edge on the support means.

7. Apparatus according to claim 1 wherein the drive means includes power driven carriage means mounted on the support means.

8. Apparatus according to claim 1 wherein deactivating means is provided for controlling the travel of the drive means in response to any unprogrammed interruption of the movement of the mattress innerspring and the borderwires in the direction of the clip wrapping means.

9. Apparatus according to claim 8 wherein the deactivating means comprises a photoelectric cell.

10. Apparatus according to claim 9 wherein said deactivating means includes pivotally mounted reflector means for deenergizing the photoelectric cell when the movement of the drive means is interrupted by an unprogrammed event.

11. Apparatus according to claim 1 wherein gripper means is provided for maintaining the mattress innerspring and the borderwires on the support means during turning.

12. Apparatus according to claim 1 wherein sensor means is provided for sequentially deactivating the drive means as the drive means advances the mattress innerspring and the borderwires along the support means.

13. Apparatus according to claim 1 wherein sensor means is provided for activating the clip wrapping means.

14. Apparatus according to claim 1 wherein sensor means is provided for effecting movement of the drive means in a direction away from the clip wrapping means.

15. Apparatus according to claim 1 wherein air cylinder means is provided for said movable means for turning the mattress innerspring and the borderwires on the support means.

16. Apparatus according to claim 15 wherein sensor means is provided for activating the air cylinder means.

17. Apparatus according to claim 1 wherein clip supply means is connected to the clip wrapping means.

18. Apparatus according to claim 1 wherein reciprocatable stop means is provided for engaging the lead end of a mattress innerspring and the borderwires prior to activation of the clip wrapping means to establish a reference point for the control means.

19. Apparatus according to claim 18 wherein sensor means is provided for activating the stop means.

20. Apparatus according to claim 1 wherein the support means comprises a frame member having an upwardly extending portion for maintaining a mattress innerspring and borderwires in a substantially upright position on the support means, and a guide portion along which an edge of the mattress innerspring and the borderwires are advanced by the drive means.

21. Apparatus according to claim 20 wherein a segment of the guide portion is pivotally mounted with relation to the support means.

22. Apparatus according to claim 20 wherein the upwardly extending portion of the frame member is provided with a smooth surface to enable the mattress innerspring and the borderwires to be moved freely therealong.

23. Apparatus according to claim 20 wherein sensor means is associated with the upwardly extending portion of the frame member, the energization of the sensor means being dependent upon the perimetric dimensions of the mattress innerspring and borderwires.

24. Apparatus according to claim 20 wherein the upwardly extending portion and the guide portion are adjustably mounted on the frame member.

25. Apparatus according to claim 1 wherein the control means includes a plurality of pneumatic solenoid valves in communication with a source of air under pressure.

26. Apparatus according to claim 1 wherein the support means is structured to enable it to be readily moved from one location to another in a work area.

27. Apparatus according to claim 1 wherein the support means is provided with casters to facilitate movement thereof from one location to another in a work area.

28. Apparatus according to claim 1 wherein the clip wrapping means is mounted on the support means for reciprocatable movement with relation to the coils of the mattress innerspring.

29. Apparatus for automatically securing borderwires on mattress innersprings, comprising: a frame member having an upwardly extending portion for maintaining a mattress innerspring and borderwires in a substantially upright position on the frame member, and a guide portion for receiving an edge of the mattress innerspring and borderwires; a plurality of clip wrapping tools positioned along the guide portion of the frame member for wrapping clips on the borderwires and the coils of the mattress innerspring along said edge; drive means mounted on the frame member for advancing the mattress innerspring and the borderwires along the guide portion of the frame member in the direction of the clip wrapping tools; control means for sequentially deactivating the drive means and activating the clip wrapping means whereby the coils of the mattress innerspring are successively secured to the borderwires along said edge; and turning means pivotally mounted with relation to the frame member for rotating the mattress innerspring and the borderwires through an angle to position a different edge of the mattress innerspring and the borderwires on the guide portion of the frame member.

30. Apparatus according to claim 29 wherein a pair of adjustable clip wrapping tools are positioned in opposed relation to one another along the guide portion of the frame member.

31. Apparatus according to claim 29 wherein the drive means is secured to a carriage movably mounted on the frame member.

32. Apparatus according to claim 31 wherein deactivating means is provided for the drive means, said deactivating means including a photoelectric cell and reflector means, said reflector means being pivotably mounted on the carriage.

33. Apparatus according to claim 31 wherein the carriage is provided with gripper means for engaging the rear edge of the mattress innerspring and the borderwires as they are advanced along the guide portion of the frame member.

34. A method of securing borderwires on the coils of a mattress innerspring, comprising: providing support means for supporting a mattress innerspring and borderwires on edge in a substantially upright position; advancing said edge of the mattress innerspring and borderwires along the support means to a clip wrapping station positioned adjacent to the support means; interrupting the advance of said edge of the mattress innerspring and borderwires at the clip wrapping station; simultaneously wrapping a plurality of clips on the borderwires and the coils of the mattress innerspring at the clip wrapping station; continuing the advance of said edge of the mattress innerspring and borderwires along the support means and the interruption thereof at the clip wrapping station until the borderwires are secured to the coils of the mattress innerspring along said edge; and turning the mattress innerspring and borderwires while supported in a substantially upright position on the support means until the coils of the mattress innerspring and borderwires along each of the other edges thereof have been wrapped with clips at the clip wrapping station.

35. A method according to claim 34 wherein the mattress innerspring and borderwires are turned through an angle of approximately 90° to position each edge thereof in clip wrapping relation to the clip wrapping station.

36. A method according to claim 34 wherein the mattress innerspring and borderwires are advanced along the support means at an angle of declination of about 15° to vertical.

37. A method according to claim 34 wherein the advance of the mattress innerspring and borderwires along the support means, the wrapping of clips at the clip wrapping station, and the turning of the mattress innerspring and borderwires are performed automatically.

* * * * *